US011060370B2

(12) United States Patent
Matthews

(10) Patent No.: US 11,060,370 B2
(45) Date of Patent: Jul. 13, 2021

(54) DOWNHOLE AGITATOR TOOLS, AND RELATED METHODS OF USE

(71) Applicant: Shane Matthews, Edmonton (CA)

(72) Inventor: Shane Matthews, Edmonton (CA)

( * ) Notice: Subject to any disclaimer, the term of this patent is extended or adjusted under 35 U.S.C. 154(b) by 0 days.

(21) Appl. No.: 16/542,972

(22) Filed: Aug. 16, 2019

(65) Prior Publication Data

US 2020/0056437 A1 Feb. 20, 2020

(30) Foreign Application Priority Data

Aug. 16, 2018 (CA) ..... CA 3014372

(51) Int. Cl.
*E21B 31/00* (2006.01)

(52) U.S. Cl.
CPC ..... *E21B 31/005* (2013.01)

(58) Field of Classification Search
CPC ..... E21B 31/005
USPC ..... 175/57
See application file for complete search history.

(56) References Cited

U.S. PATENT DOCUMENTS

| | | | | |
|---|---|---|---|---|
| 9,598,923 | B2 | 3/2017 | Gilleylen | |
| 2012/0048619 | A1 | 3/2012 | Seutter et al. | |
| 2014/0102804 | A1 | 4/2014 | Cote | |
| 2014/0151068 | A1 * | 6/2014 | Gilleylen | E21B 28/00 166/381 |
| 2016/0130898 | A1 | 5/2016 | Solem | |

OTHER PUBLICATIONS

Grifco, Pulling Tool for External Fishing Necks, accessed Jun. 21, 2018 but available at least as early as Aug. 16, 2018, 2 pages, URL=http://www.grifco-oiltools.com/products/pullingtoolforexternalfishingnecks.htm.

Shultz, Vibratory Downhole Tool Technologies with Application to Horizontal Drilling and Casing Installation, available as early as Feb. 2013, 21 pages, TTS Drilling Solutions.

Omega, Releasable Rope Socket Drop Bar, available as early as Aug. 16, 2018, 6 pages, screenshots taken from Wayback machine Internet archive, URL=https://web.archive.org/web/20180710154134/http://www.omega-intervention.com/index.php/products/wireline/releasable-rope-socket.

Brace Tool, Wireline Fishing Tools, accessed Oct. 4, 2019 but substantive content believed to be available as early as Aug. 16, 2018, 2 pages, URL=https://www.bracetool.com/definition/426/wireline-fishing-tools.

Brace Tool, Wireline Equipment, accessed Oct. 4, 2019 but substantive content believed to be available as early as Aug. 16, 2018, 2 pages, URL=https://www.bracetool.com/definition/415/wireline-equipment.

Youtube, Screenshot of Basket Grapple Overshot, accessed Oct. 7, 2019 but available as early as May 2, 2014, 2 pages, URL=https://www.youtube.com/watch?v=EIUTUJJ8L7M.

(Continued)

*Primary Examiner* — Taras P Bemko
(74) *Attorney, Agent, or Firm* — Robert A. Nissen

(57) ABSTRACT

An apparatus may have a drill string located in a well that penetrates a formation within the earth; and a downhole tool located as part of the drill string, the downhole tool comprising a landable and/or retrievable agitator. A downhole tool has a housing and a landable or retrievable agitator. An apparatus has plural retrievable and/or landable agitators positioned in series in a tubing string downhole.

21 Claims, 4 Drawing Sheets

(56) References Cited

OTHER PUBLICATIONS

Omega, Drop Bar Data Sheet, accessed Feb. 7, 2020, but available as early as 2017, 2 pages, URL=http://www.omega-intervention.com/images/Drop-Bar-Slider/Drop-Bar.pdf.
Omega, Releasable Rope Socket Data Sheet, accessed Feb. 7, 2020, but available as early as 2017, 2 pages, URL=http://www.omega-intervention.com/images/Drop-Bar-Slider/Drop-Bar.pdf.

* cited by examiner

DOWNHOLE AGITATOR TOOLS, AND RELATED METHODS OF USE

TECHNICAL FIELD

This document relates to downhole agitator tools, and related methods of use.

BACKGROUND

An agitator may be included as part of drill string in order to vibrate the string during drilling operations to reduce friction with between the drill string and the bore wall. Downhole tools exist that contain removable components.

SUMMARY

A method is disclosed comprising: operating a drill string, which is disposed within a well that penetrates a formation within the earth, to drill or ream the formation, the drill string comprising a sub that defines a longitudinal bore from an uphole end to a downhole end of the sub; passing an agitator from surface through the drill string and landing the agitator on a landing seat within the longitudinal bore of the sub, the agitator comprising a fluid-actuated motor; and flowing fluid through the drill string and longitudinal bore to actuate the fluid-actuated motor to impart vibrations upon the drill string.

A downhole tool is also disclosed comprising: an outer sub housing defining a longitudinal bore extending from an uphole end to a downhole end of the outer sub housing, the outer sub housing further defining a landing seat within the longitudinal bore; and an agitator receivable upon the landing seat, the agitator containing a fluid-actuated motor that is structured to vibrate the downhole tool by converting energy from fluid flowing, during use, through the longitudinal bore from an uphole end of the agitator to a downhole end of the agitator.

A downhole tool assembly is also disclosed comprising: a first sub defining a longitudinal bore extending from an uphole end to a downhole end of the first sub, the first sub further defining an uphole-facing seat within the longitudinal bore of the first sub; a second sub defining a longitudinal bore extending from an uphole end to a downhole end of the second sub, the second sub further defining an uphole-facing seat within the longitudinal bore of the second sub, the second sub connected to the first sub; a first agitator structured to seat upon the uphole-facing seat of the first sub; and a second agitator structured to pass through the uphole-facing seat of the first sub and seat upon the uphole-facing seat of the second sub.

A drill string sub comprises: a sub housing defining a longitudinal bore and a an internal seat landing platform; a retrievable agitator assembly positioned within the longitudinal bore, the retrievable agitator assembly comprising: an uphole end structured to facilitate removal of the retrievable agitator assembly from the sub housing via a wireline; and a shoulder positioned against the seat and secured in position via fluid pressure.

An apparatus comprising: a drill string located in a well that penetrates a formation within the earth; and a downhole tool located as part of the drill string, the downhole tool comprising a landable and/or retrievable agitator.

An apparatus comprises plural retrievable and/or landable agitators positioned in series in a tubing string downhole. The embodiments here may be used in tubing strings such as drill strings, reaming strings, casing strings, liner strings, coil tubing strings, and others.

In various embodiments, there may be included any one or more of the following features: Retrieving the agitator from within the longitudinal bore of the sub. Retrieving is carried out using a cable extended from surface. The cable comprises a grapple that grips an uphole end of the agitator. Passing comprises dropping the agitator into the well bore and guiding the agitator onto the landing seat using fluid pressure. Passing is carried out while the sub is located in a horizontal or deviated part of the well. The agitator comprises an outer casing that contains the fluid-actuated motor. The landing seat of the outer sub housing and a downhole-facing seat-contacting surface of the agitator are structured to cooperate to guide the agitator to be passed from uphole through a drill string and landed upon the landing seat within the longitudinal bore while the outer sub housing is located downhole as part of the drill string. One or both of the downhole-facing seat-contacting surface and the landing seat are tapered to guide the agitator to seat upon the landing seat. The landing seat is tapered with increasing inner diameter in a direction toward the uphole end of the outer sub housing. The downhole-facing seat-contacting surface is tapered with decreasing outer diameter in a direction toward the downhole end of the agitator. The landing seat is formed by an annular shoulder. The downhole-facing seat-contacting surface of the agitator is annular. One or both the agitator and the landing seat are structured to restrict relative rotation between the agitator and the outer sub housing. The landing seat is defined by a restriction that is integral with an external wall of the outer sub housing. The fluid-actuated motor comprises a cam shaft with one or more turbine vanes. The fluid-actuated motor is mounted to a compressible element. The uphole end of the agitator comprises a fishing neck. The agitator comprises an outer casing that supports the fluid-actuated motor. A drill string located in a well that penetrates a formation within the earth. The downhole tool located as part of the drill string. The outer sub housing is located in a horizontal or deviated part of the well. A minimum inner diameter of the uphole-facing seat of the second sub is smaller than a minimum inner diameter of the uphole-facing seat of the first sub. The downhole tool assembly comprises a third sub defining a longitudinal bore extending from an uphole end to a downhole end of the third sub, the third sub further defining an uphole-facing seat within the longitudinal bore of the third sub, the third sub connected to the second sub, a third agitator structured to pass through the uphole-facing seats of the first sub and second sub, and structured to seat upon the uphole-facing seat of the third sub. The first agitator is structured to, in use, be passed in a downhole direction from surface to land upon the seat of the first sub, and the second agitator is structured to, in use, be passed in a downhole direction from surface to pass through the first sub and land upon the seat of the second sub. The first agitator is structured to, in use, be lifted from the seat of the first sub and withdrawn in use from the first sub in an uphole direction, and the second agitator is structured to, in use, be lifted from the seat of the second sub and withdrawn in use from the second sub and first sub in an uphole direction. Operating a drill string within a well that penetrates a formation within the earth, the drill string comprising the downhole tool assembly. The outer casing comprises a cylindrical casing that contains the fluid-actuated motor. The agitator contains a fluid-actuated motor that is structured to vibrate the downhole tool by converting energy from fluid flowing, during use, through the longitudinal bore from an uphole end of the agitator to a downhole end of the agitator.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Figures 1, 2, 3:
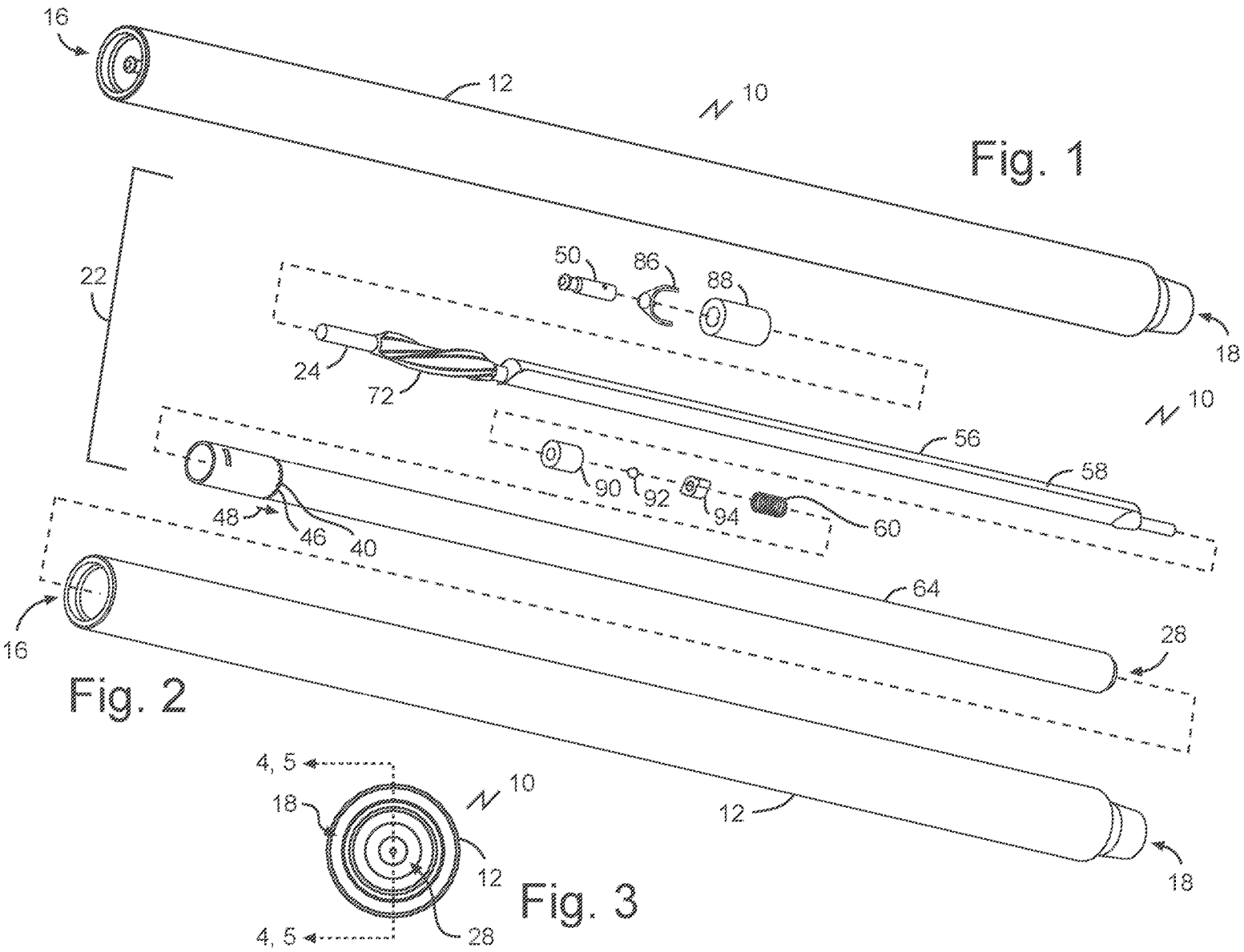
FIG. 1 is a perspective view of a downhole tool for imparting vibrations upon a drill string.
FIG. 2 is an exploded view of the downhole tool of FIG. 1.
FIG. 3 is an end elevation view of a downhole end of the downhole tool of FIG. 1.

Immaterial modifications may be made to the embodiments described here without departing from what is covered by the claims.

During well exploration, particularly drilling operations, contact between a drill string and a wellbore may generate frictional forces, leading to restrictive torque and drag. Additional torque and drag can result in low rates of penetration, poor tool face control, short runs, and severe drill string and bit wear, for example when running casing, liners, and during completions. High friction can also lead to high well tortuosity, which can impair well productivity. Contact between a drill string and a wellbore may be caused by string buckling, deformed coiled tubing, deviated wellbore, gravitation forces acting on the drill string in the horizontal section of the well, and hydraulic loading against the wellbore. Sand and debris in the wellbore may exacerbate the amount of friction generated by such contact.

Agitator tools, for example rotary valve pulse tools, oscillatory flow-modulation tools, and poppet/spring-mass tools, may be used to create vibrations in a drill string. Controlled vibrations can reduce the build-up of solid materials around the drill string, reduce friction and stick slip, prevent the drill string from becoming stuck in the well, improve rates of penetration, and extend the operating range and measured depth achievable by a drilling assembly. Vibrations may be generated by imparting unbalanced forces upon the drill string, whether by reciprocation (such as repeated extension and contraction of the drill string), rotation of a cam, oscillating fluid movement, and other mechanisms, thus breaking static friction between string and the wellbore. Rotary valve pulse tools may be used with a rotor mounted in a stator and connected to a valve, which may be structured to temporarily disrupt fluid flow to create and release fluid pressure within the tool. Oscillatory flow-modulation tools may create a specialized fluid path structured to create a varying flow resistance that functions similar to an opening and closing valve. Poppet/spring-mass tools may incorporate a sliding mass, a valve, and spring components that oscillate in response to flow through the tool. Such mechanisms may create a mechanical hammering and/or flow interruption.

A downhole agitator tool may be formed of a number of parts, for example as discussed above, that limit or restrict various operations. For one, an agitator may restrict through-bore operations such as maintenance, repair, and fishing to be performed below such tools. To perform through-bore operations, an agitator tool or parts may need to be removed from the drill string, with such removal entailing removing substantial portions of the drill string, increasing time and costs of the downhole operation. Secondly, the agitator may restrict drilling function. The back pressure generated by the agitator within the drill string bore may reduce the maximum power and hence drilling function of the drill bit. Thus, although many drill strings will incorporate an agitator in order to reduce friction and improve drilling function, such agitator may have a deleterious effect on maximum drilling power.

Figures 4, 5:
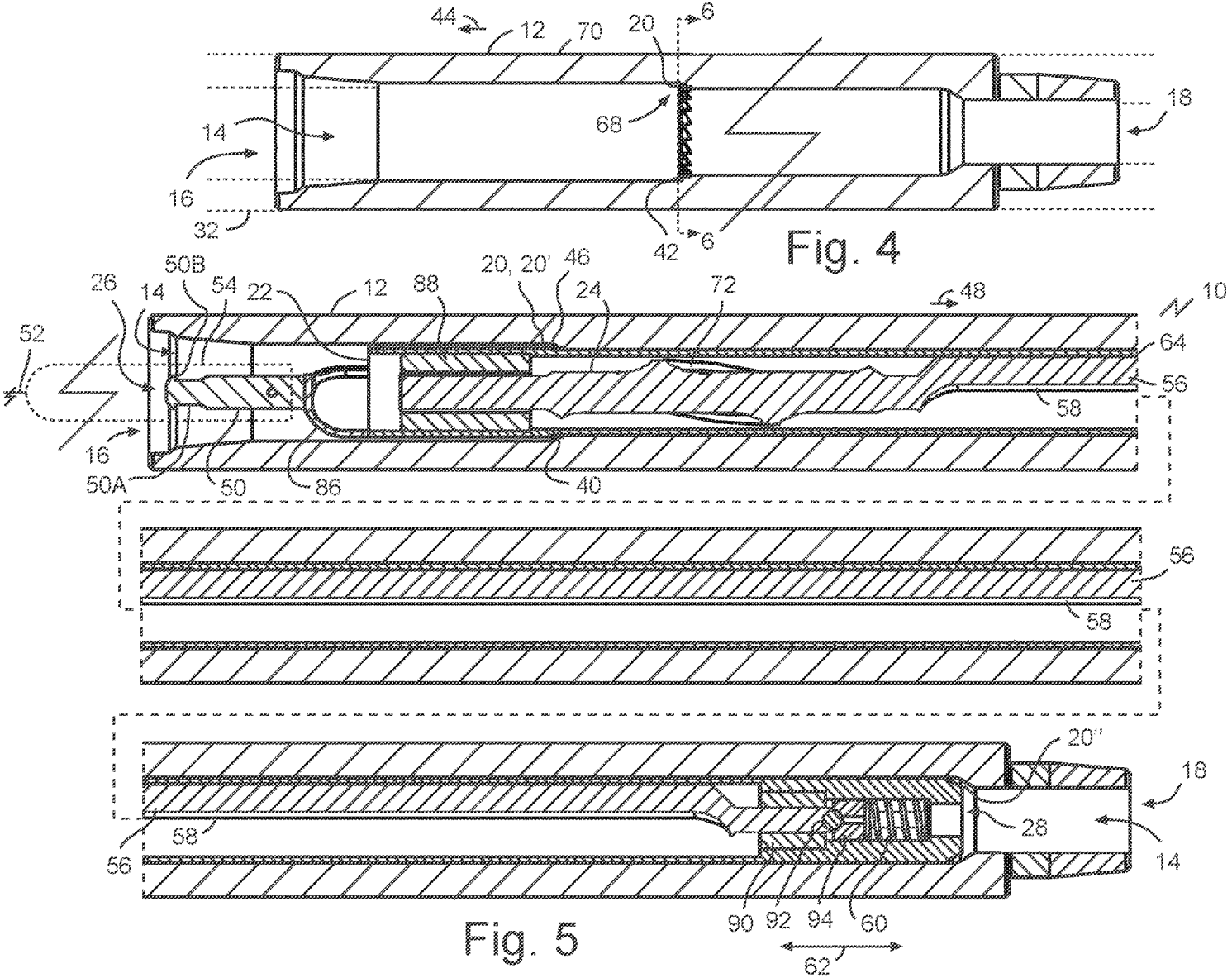
FIG. 4 is a section view taken along the 4-4 section lines from FIG. 3, with the inner components removed to illustrate the outer sub housing, and with uphole and downhole drill string joints illustrated with dashed lines.
FIG. 5 is a section view taken along the 5-5 section lines from FIG. 3, with a fishing tool illustrated with dashed lines and gripping an uphole end of the agitator.

Referring to FIG. 2, a downhole tool 10 is illustrated comprising an outer sub housing 12 and an agitator 22. Referring to FIG. 4, the outer sub housing 12 may define a longitudinal bore 14, for example extending from an open uphole end 16 to an open downhole end 18 of the outer sub housing 12. The outer sub housing 12 may define a seat 20, such as a landing seat as shown, within the longitudinal bore 14. Referring to FIG. 5, the agitator 22 may sit upon, and in some cases be receivable upon, the landing seat 20. More than one seat 20 may be present, such as seat 20". Seat 20 may be located at or adjacent an uphole end 26 of the agitator 22, or in other cases closer to the uphole end 26 than the downhole end 28 of the agitator. Referring to FIG. 5, the agitator 22 may comprise a fluid-actuated motor 24, for example that is structured to convert energy from fluid flowing, during use, through the longitudinal bore 14 from the uphole end 26 of the agitator 22 to the downhole end 28 of the agitator 22, to vibrate the downhole tool 10.

Figure 7:
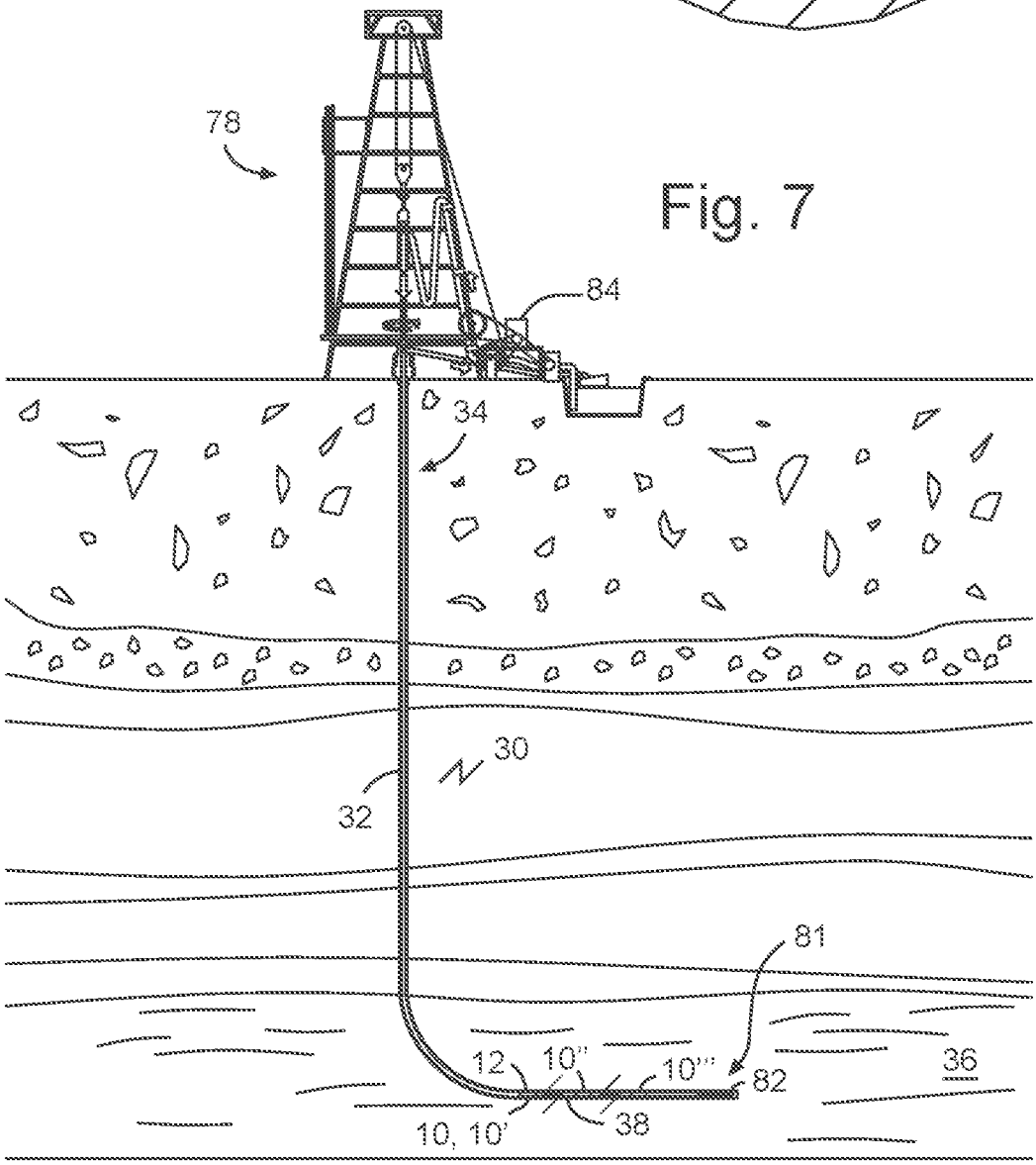
FIG. 7 is a side elevation view of a drill string within a well that penetrates a formation within the earth, with three units of the downhole tool of FIG. 1 connected in series within the drill string.

Referring to FIG. 7, the downhole tool 10 may be located as part of a drill string 32, for example as a sub, which may be located at a suitable part of the string 32 such as adjacent or as part of the bottom hole assembly. The drill string 32 may be located in a well 34, for example that penetrates a formation 36, such as an oil-bearing or other hydrocarbon-bearing formation, within the earth. The outer sub housing 12 of the downhole tool 10 may be located in a horizontal or deviated part 38 of the well 34, if string 32 is located in a horizontal or deviated well.

Referring to FIGS. 2 and 7, the downhole tool 10 may be structured to facilitate passing, for example via dropping, the agitator 22 (FIG. 2) from surface to a land on seat 20 downhole. Referring to FIGS. 5 and 7, one or more of the open uphole end 16 of the outer sub housing 12, the landing seat 20 of the outer sub housing 12, and a downhole-facing seat-contacting surface 40 of the agitator 22, may be structured to cooperate to guide the agitator 22 to be passed or otherwise dropped from surface through the drill string 32 (FIG. 7) and landed upon the landing seat 20, or other suitable landing surface, within the longitudinal bore 14, for example while the outer sub housing 12 is located downhole as part of the drill string 32. The agitator 22 may be guided onto the landing seat 20 via fluid pressure. In use, the outer sub housing 12 may be located in the deviated part 38 (FIG. 7) of the well 34 (FIG. 7), such that the agitator 22 is passed into the part 38 and into the housing 12, for example using fluid pressure, tubing, or a tractor.

Referring to FIG. 5, one or both of the downhole-facing seat-contacting surface 40 and the landing seat 20 may be structured to facilitate landing of the agitator 22 within the longitudinal bore 14. One or both of the downhole-facing seat-contacting surface 40 and the landing seat 20 may be tapered to guide the agitator, for example to permit the agitator 22 to center within the longitudinal bore 14 and be received upon the landing seat 20. Referring to FIG. 4, the landing seat 20 may be formed by an annular shoulder 42. The annular shoulder 42 of the landing seat 20 may be tapered with increasing inner diameter in a direction 44 toward the open uphole end 16 of the outer sub housing 12. Referring to FIGS. 2 and 5, the downhole-facing seat-contacting surface 40 of the agitator 22 may be annular. The downhole-facing seat-contacting surface 40 may be formed by an annular shoulder 46. The downhole-facing seat-contacting surface 40 may be tapered with decreasing outer diameter in a direction 48 toward the downhole end 28 of the agitator 22. Referring to FIG. 4, the landing seat 20 may be defined by a restriction 68, for example that is integral with an external wall 70 of the outer sub housing 12.

Referring to FIG. 5, the agitator 22 may have a structure suitable for retrieval. The uphole end 26 of the agitator 22 may comprise a fishing neck 50, for example having a base 86, such as two, three, or more legs that connect the neck 50 to the agitator 22 while permitting fluid flow through bore 14. A fishing neck 50 is a surface on which a fishing tool, such as a grapple 54 (an overshot grapple is shown), engages when retrieving tubing, tools or equipment stuck or lost in a wellbore. Tools and equipment that are temporarily installed in a wellbore are generally equipped with a specific fishing-neck profile, such as a narrow part 50A connect to a flange 50B or other shoulder, to enable a running and retrieval tool to reliably engage and release the neck 50. The agitator 22 may be connected, for example by grapple 54, to a cable. The grapple 54 may be structured to grip the uphole end 26 or fishing neck 50 of the agitator 22 during retrieval. A grapple overshot may incorporate a latching system such as a collet that grips the outer surface of the tool. Other suitable fishing tools may be used to engage the fishing neck 50. The cable 52 may be extended from surface, for example to permit retrieval of the agitator 22 to surface via retraction of the cable 52 to surface. The cable 52 may be retracted via a winch, crane or other suitable mechanism. The agitator 22 may be retrieved from within the longitudinal bore 14 of the outer sub housing 12, for example after being landed within the bore 14 and thereafter carrying out drilling or reaming operations while imparting vibrations upon a drill string.

Referring to FIGS. 5 and 7, the agitator 22 may have a structure suitable for imparting vibrations upon the drill string 32 (FIG. 7). Referring to FIG. 5, fluid-actuated motor 24 may comprise a cam shaft 56, for example with one or more turbine vanes 58. The cam shaft 56 may be eccentrically weighted, for example to impart vibrations upon the drill string 32 when the cam shaft 56 is rotated. The cam shaft 56 may be connected to or form a rotor 72, for example that rotates when fluid flows through the longitudinal bore 14 from the uphole end 26 of the agitator 22 to the downhole end 28 of the agitator 22. In other cases the agitator 22 may have a pulse generating assembly, for example a valve assembly or other suitable part for imparting vibrations upon the drill string 32 via fluctuations in fluid pressure. In other cases a reciprocating element may be used to impart vibrations. The agitator 22 may form a part that independently imparts vibrations without cooperating with other parts of the tool, thus forming a fully contained module that can be removed or added to the housing 12 as desired or required.

Referring to FIG. 5, fluid-actuated mounted may cam shaft 56 may be mounted to or comprise a compressible element 60. Neck 50 may permit the cam shaft 56 or other parts of the motor or agitator to translate, for example in axial directions 62, upon an axial force being imparted upon the motor or cam shaft 56, for example from varying fluid pressure. The element 60 may also reduce the impact of landing the agitator 22 on the seat 20, minimizing potential for damage during such landing. Referring to FIGS. 2 and 5, the compressible element 60 may be connected to the cam shaft 56 via a suitable structure, such as a bushing such as formed by a bearing ball 92 and a bearing race 94. Other suitable bushings may be used such as a polycrystalline diamond compact thrust bearing.

Figure 9:
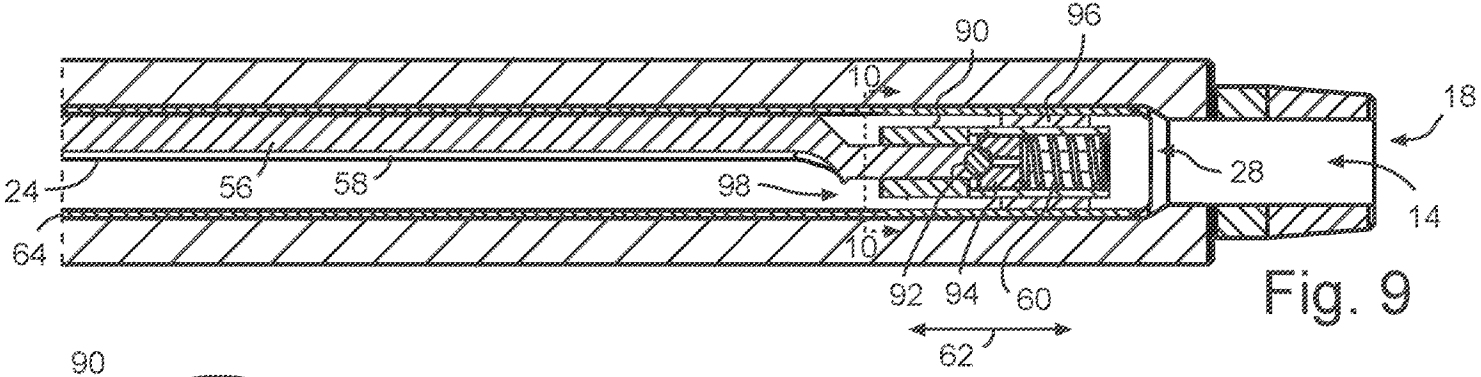
FIG. 9 is a cross section view of another embodiment of a downhole tool.
Figure 10:
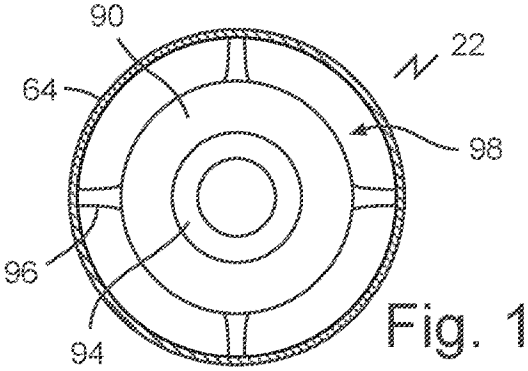
FIG. 10 is a section view taken along the 10-10 section lines from FIG. 9, with the outer sub housing removed for illustrative purposes.

Referring to FIGS. 2 and 5, the agitator 22 may be provided in a modular, compact form. For example, agitator 22 may be provided as a cartridge, with an outer casing 64, for example that supports, for example contains, the fluid-actuated motor 24. The outer casing 64 may comprise a cylindrical casing or other casing structure suitable for passing through the interior bore of a drill string. The outer casing 64 may be structured to receive an uphole end bushing 88 and a downhole end bushing 90, for example a tungsten carbide radial bearing, that support the fluid-actuated motor 24 within the outer casing 64. Referring to FIGS. 9 and 10, one or more of the fluid-actuated motor 24, the downhole end bushing 90, the bearing race 94, and the compressible element 60 may be mounted to the outer casing 64 via one or more support fins 96, for example to define one or more fluid channels 98 to pass fluid into or out of the motor 24.

Figure 6:
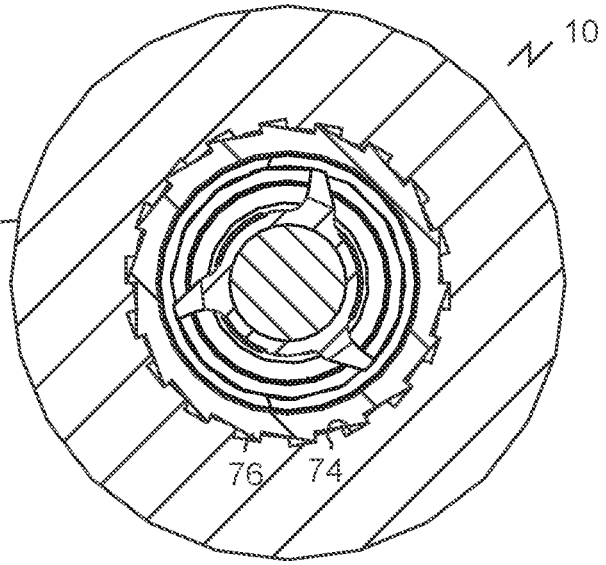
FIG. 6 is a cross-sectional view, taken along the 6-6 section lines from FIG. 4, with the agitator added to the drawing.

Referring to FIGS. 4 and 6, the downhole tool 10 may be structured to restrict relative rotation of the agitator 22 within the outer sub housing 12. Referring to FIG. 5, one or both the downhole-facing seat-contacting surface 40 and the landing seat 20 may be structured to restrict relative rotation between the agitator 22 and the outer sub housing 12. Referring to FIG. 6, the seat 20 and agitator 22 may grip one another via teeth. The landing seat 20 may define one or more slots 74, for example structured to receive one or more teeth 76 of the downhole-facing seat-contacting surface 40. The longitudinal bore 14 may be a smooth bore, for example with movement of the agitator 22 within the outer sub housing 12 restricted via fluid pressure. The arrangement of teeth illustrated may not be used in other embodiments, for example embodiments may instead use splines, friction fits, or static friction created by application of fluid pressure against the agitator 22.

Figure 8:
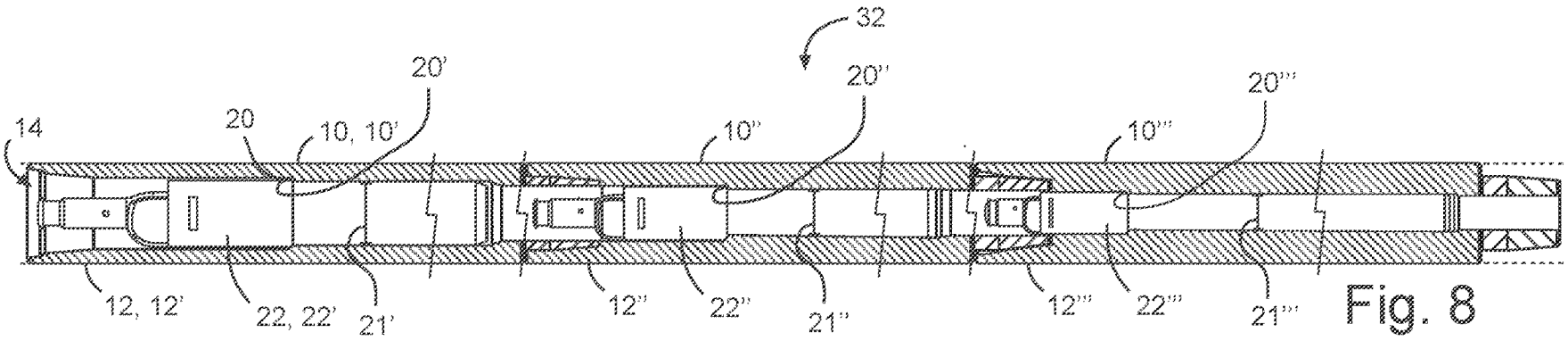
FIG. 8 is a partial cutaway side elevation view of three units of the downhole tool connected in series, with respective outer sub housings of the downhole tools cutaway to illustrate the relative dimensions of the respective longitudinal bores and agitator assemblies.

Referring to FIGS. 7-8, plural agitator subs may be connected in series in the drill string 32. For example, two, three (shown), or more subs may be used, each with removable and/or landable agitators 22. One or more intermediate subs or drill string sections may be positioned between each sub, so that connections between subs are either direct (agitator subs connect direct to one another) or indirect (other subs or drill string sections connect between agitator subs). Referring to FIG. 8, a first sub or tool 10', a second sub or tool 10", and a third sub or tool 10' may be present.

Referring to FIG. 8, each tool 10 may have associated with it a suitably dimensioned agitator 22, such as respective agitators 22', 22", and 22'". Each agitator 22', 22", and 22'" has associated with it a suitable dimensioned respective sub housing 12', 12" and 12'. The first agitator 22' may be structured to seat upon the uphole-facing seat 20' of the first tool 10'. The second agitator 22" may be structured to pass through the uphole-facing seat 20' of the first tool 10' and seat upon the uphole-facing seat 20" of the second tool 10". For example, a minimum inner diameter 21" of the uphole-facing seat 20" of the second tool 10" is smaller than a minimum inner diameter 21' of the uphole-facing seat 20' of the first tool 10'. A third agitator 22'" may be structured to pass through the uphole-facing seats 20', 20" of the first tool and second tools 10', 10", respectively. The third agitator 22' may be structured to seat upon the uphole-facing seat 20'" of the third tool 10'". For example, a minimum inner diameter 21' of the uphole-facing seat 20'" of the third tool 10'" is smaller than minimum inner diameters 21' and 21" of the uphole-facing seats 20', 20" of the first and second tools 10', 10". Agitators may be sized to drift diameter to ensure no hang-ups during installation/removal.

Referring to FIG. 8, the agitators 22 and housings 12 may be structured to permit landing of the agitators 22 on the housings 12. The first agitator 22' may be structured to, in use, be passed in a downhole direction from surface to land upon the seat 20' of the first tool 10'. Due to the size of the seat 20', the agitator 22' is prohibited from passing to the other tools 10" and 10'. The second agitator 22" may be structured to, in use, be passed in a downhole direction from surface to pass through the first tool 10' and land upon the seat 20" of the second tool 10'". Due to the size of the seat 20", the agitator 22" is prohibited from passing to the other tool 10'". The third agitator 22' may be structured to, in use, be passed in a downhole direction from surface to pass through the first tool 10' and second tool 10" and land upon the seat 20' of the third tool 10'". Due to the size of the seat 20'", the agitator 22' is prohibited from passing beyond the seat 20'". Landing of a bigger agitator would block landing of a smaller agitator, and thus, landing of agitators must be carried out in order from smallest diameter to largest diameter agitators. Each agitator 22 may have a maximum diameter that is less than the minimum inner diameter of any longitudinal bore located farther uphole and greater than the minimum inner diameter of any longitudinal bore located farther downhole.

Referring to FIG. 8, the agitators 22 and housings 12 may be structured to permit retrieval of the agitators 22 from the housings 12. The first agitator 22' may be structured to, in use, be lifted, for example using a grapple or other fishing tool, from the seat 20' of the first tool 10' and withdrawn in use from the first tool 10' in an uphole direction. The second agitator 22" may be structured to, in use, be lifted from the seat 20" of the second tool 10" and withdrawn in use from the second tool 10" and first tool 10" in an uphole direction. The third agitator 22'" may be structured to, in use, be lifted from the seat 20'" of the third tool 10'" and withdrawn in use from the first, second, and third tools 10', 10", and 10'" in an uphole direction. Retrieval of a smaller agitator would be prohibited by the presence of a larger agitator, and hence retrieval must be carried out in order of largest diameter to smallest diameter agitators.

Referring to FIGS. 7 and 8, plural sub housings 12, for example three outer sub housings 12', 12", and 12'", may be connected to the drill string 32 and installed or inserted into the well 34 in conjunction with the drill string 32 at suitable locations. The outer sub housing 12 located farthest downhole, for example outer sub housing 12'", may be located a suitable distance, such as 200 meters to 500 meters, uphole from a bottom hole assembly 81 of the drill string 32. An intermediate outer sub housing 12, for example the outer sub housing 12", may be located a suitable distance, such as 500 meters to 1000 meters, uphole from the outer sub housing 12". The outer sub housing 12', may be located a suitable distance, such as at an uphole end of the horizontal or deviated part 38, from assembly 81. In some cases the agitators are spaced at suitable intervals along the well as needed to reduce friction on the drill string.

Referring to FIG. 7, the drill string 32 may be supported within the well 34 by a suitable structure such as a derrick 78. The derrick 78 may have a motor 84 or other suitable power source that may be used to operate one or more of drills, pumps, winches, and other suitable parts as is known in the art for drilling a well. The drill string 32 may be operated to drill or ream the formation 36, for example via a drill bit 82. Embodiments include incorporating the agitator tool 10 in a drilling with casing application. During drilling or reaming, for example when an agitator such as agitators 22', 22", or 22'" are landed or retrieved, one or more of the respective outer sub housings 12', 12", and 12'" may be located in the deviated part 38 of the well 34.

Referring to FIGS. 7-8, a suitable method may proceed as follows. A drill string 32 may be inserted into a well 34. The drill string 32 may at least initially include one or more outer sub housings 12', 12", and 12'", which may be in a hollow or unoccupied state where no internal agitator 22 is lodged therewithin. The drill string may be operated, for example using derrick 78 and equipment or motor 84, to drill or ream the formation. The lack of presence of agitators 22 in housings 12 may reduce back pressure and increase maximum fluid pressure that can be supplied to rotate drill bit 82. The initial stages of the well may be drilled faster than if agitators were present to create back pressure. A deviated well may be drilled, such as forming a horizontal part 38.

Figure 11:
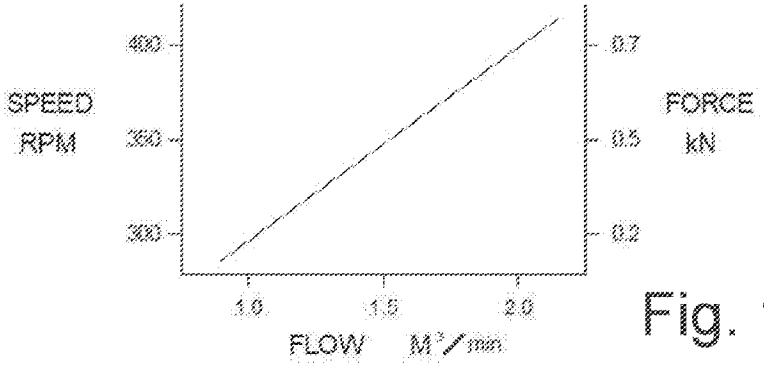
FIG. 11 is a graph of agitator speed versus fluid flow and force.

Referring to FIGS. 7 and 8, at some point in the drilling or reaming process the function of one or more of agitators 22 may be desired. In such a case, one or more agitators 22, for example agitators 22', 22", and 22'", may be passed from surface through the drill string 32 and landed within one or more outer sub housings 12. The agitators 22', 22", and 22'" may be dropped, guided, and/or landed on respective landing seats 20 within respective longitudinal bores 14 of the outer sub housings 12', 12", and 12" via fluid pressure. Referring to FIG. 11, a graph is illustrated detailing an exemplary relationship between fluid flow and agitator force and speed.

Referring to FIGS. 7 and 8, after landing, or at any point when agitators 22 are present (for example if tools 10 are supplied downhole with agitators 22 pre-installed), drilling or reaming operations may be carried out. Fluid may be flowed through the drill string 32 to actuate one or more fluid-actuated motors 24 (FIG. 5) to impart vibrations upon the drill string 32, for example via a pump powered by the motor 84. Agitators 22 may be advantageous to reduce friction between the drill string 32 and the well 34, to permit elongation and proper construction of well 34.

Referring to FIGS. 5 and 7-8, at some point one or more agitators may be retrieved from the drill string 32. For example, the agitator 22 located farthest uphole, for example agitator 22', may be connected to a cable 52 extended from surface, for example via a grapple 54. The cable 52 may be retracted to surface to retrieve the agitator 22' from within the longitudinal bore 14, for example via a winch, crane, or other suitable part powered by motor 84. Any other agitator assemblies present within the drill string 32 may then be retrieved in succession via the same or similar methods. Once an agitator is removed from its respective outer housing, a through-bore operation may be commenced, for example to pass a tool through the respective longitudinal bore of the tool from which the agitator was removed. Once through-bore operations are completed the respective agitator or agitators may be re-landed and drilling may continue, or drilling may continue in the absence of such agitator in its respective housing.

Retrieval operations of the agitator 22 may provide access to a bottom hole assembly or other parts located downhole from the agitator 22, for example to facilitate maintenance, repair, and/or retrieval of such parts. Such operations may permit installation and retrieval of the agitator 22 from the drill string 32 without the need to remove the outer sub housing 12. Thus, an operator may save the time and costs associated with disconnecting the outer sub housing 12, for example often needed when the agitator assembly is integral to the outer sub housing 12, as well as costs associated with operation of the agitator assembly 22 when vibration of the drill string 32 is not needed. Use of multiple downhole tools 10 may increase the maximum vibrational force that may be imparted on the drill string 32.

Words such as up, down, uphole, downhole, and other similar words are relative unless context dictates otherwise, and do not refer to absolute directions defined with respect to gravitational acceleration on the earth. Wireline, cable, tubing, and other suitable methods may be used to land and/or retrieve agitators on or from housings. Other forms of shock absorbers may be used instead of springs/compressible elements 60.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A method comprising:

operating a drill string, which is disposed within a well that penetrates a formation within the earth, to drill or ream the formation, the drill string comprising a sub that defines a longitudinal bore from an uphole end to a downhole end of the sub;

passing an agitator from a ground surface of the earth through the drill string and landing the agitator on a landing seat within the longitudinal bore of the sub, the agitator comprising a fluid-actuated motor; and flowing fluid through the drill string and longitudinal bore to actuate the fluid-actuated motor to impart vibrations upon the drill string.

2. The method of claim 1 further comprising retrieving the agitator from within the longitudinal bore of the sub.

3. The method of claim 2 in which retrieving is carried out using a cable extended from the ground surface.

4. The method of claim 3 in which the cable comprises a grapple that grips an uphole end of the agitator.

5. The method of claim 1 in which passing comprises dropping the agitator into the well bore and guiding the agitator onto the landing seat using fluid pressure.

6. The method of claim 1 in which passing is carried out while the sub is located in a horizontal or deviated part of the well.

7. The method of claim 1 in which the agitator comprises an outer casing that contains the fluid-actuated motor.

8. A downhole tool comprising:

an outer sub housing defining a longitudinal bore extending from an uphole end to a downhole end of the outer sub housing, the outer sub housing further defining a landing seat within the longitudinal bore;

an agitator receivable upon the landing seat, the agitator containing a fluid-actuated motor that is structured to vibrate the downhole tool by converting energy from fluid flowing, during use, through the longitudinal bore from an uphole end of the agitator to a downhole end of the agitator; and in which:

the landing seat of the outer sub housing; and a downhole-facing seat-contacting surface of the agitator;

are structured to cooperate to guide the agitator to be passed from uphole through a drill string and landed upon the landing seat within the longitudinal bore while the outer sub housing is located downhole as part of the drill string.

9. The downhole tool of claim 8 in which one or both of the downhole-facing seat-contacting surface and the landing seat are tapered to guide the agitator to seat upon the landing seat.

10. The downhole tool of claim 9 in which the landing seat is tapered with increasing inner diameter in a direction toward the uphole end of the outer sub housing.

11. The downhole tool of claim 9 in which the downhole-facing seat-contacting surface is tapered with decreasing outer diameter in a direction toward the downhole end of the agitator.

12. The downhole tool of claim 8 in which the landing seat is formed by an annular shoulder.

13. The downhole tool of claim 8 in which the downhole-facing seat-contacting surface of the agitator is annular.

14. The downhole tool of claim 8 in which one or both the agitator and the landing seat are structured to restrict relative rotation between the agitator and the outer sub housing.

15. The downhole tool of claim 8 in which the landing seat is defined by a restriction that is integral with an external wall of the outer sub housing.

16. The downhole tool of claim 8 in which the fluid-actuated motor comprises a cam shaft with one or more turbine vanes.

17. The downhole tool of claim 8 in which the fluid-actuated motor is mounted to or comprises a compressible element.

18. The downhole tool of claim 8 in which the uphole end of the agitator comprises a fishing neck.

19. The downhole tool of claim 8 in which the agitator comprises an outer casing that supports the fluid-actuated motor.

20. An apparatus comprising:

a drill string located in a well that penetrates a formation within the earth; and the downhole tool of claim 8 located as part of the drill string.

21. A downhole tool comprising:

an outer sub housing defining a longitudinal bore extending from an uphole end to a downhole end of the outer sub housing, the outer sub housing further defining a landing seat within the longitudinal bore;

an agitator receivable upon the landing seat, the agitator containing a fluid-actuated motor that is structured to vibrate the downhole tool by converting energy from fluid flowing, during use, through the longitudinal bore from an uphole end of the agitator to a downhole end of the agitator; and in which one or both the agitator and the landing seat are structured to restrict relative rotation between the agitator and the outer sub housing.

* * * * *